US007645021B2

(12) United States Patent
Turner et al.

(10) Patent No.: US 7,645,021 B2
(45) Date of Patent: Jan. 12, 2010

(54) METHOD AND DEVICE FOR SPRAY CLEANING AN INKJET PRINT HEAD

(75) Inventors: Olaf Turner, Berlin (DE); Wolfgang Muhl, Hohen Neuendorf (DE)

(73) Assignee: Francotyp-Postalia GmbH, Birkenwerder (DE)

( * ) Notice: Subject to any disclaimer, the term of this patent is extended or adjusted under 35 U.S.C. 154(b) by 487 days.

(21) Appl. No.: 11/497,046

(22) Filed: Aug. 1, 2006

(65) Prior Publication Data

US 2007/0120886 A1 May 31, 2007

(30) Foreign Application Priority Data

Nov. 2, 2005 (DE) ..... 10 2005 052 151

(51) Int. Cl.
*B41J 2/165* (2006.01)

(52) U.S. Cl. ..... 347/22; 347/28

(58) Field of Classification Search ..... 347/22, 347/28–33, 35, 36
See application file for complete search history.

(56) References Cited

U.S. PATENT DOCUMENTS

| | | | | |
|---|---|---|---|---|
| 4,371,881 | A | 2/1983 | Bork et al. | |
| 5,548,309 | A | 8/1996 | Okubo et al. | |
| 5,617,124 | A * | 4/1997 | Taylor et al. | 347/35 |
| 5,712,668 | A | 1/1998 | Osborne et al. | |
| 5,806,994 | A | 9/1998 | Coffy et al. | |
| 5,880,747 | A | 3/1999 | Bartenwerfer et al. | |
| 6,183,059 | B1 * | 2/2001 | Muhl et al. | 347/33 |
| 6,224,187 | B1 | 5/2001 | Inten et al. | |
| 6,322,196 | B1 | 11/2001 | Lim | |
| 6,390,577 | B1 | 5/2002 | Fajour | |
| 6,477,511 | B1 | 11/2002 | Guenther | |
| 6,481,827 | B2 | 11/2002 | Yearout | |
| 6,644,778 | B2 | 11/2003 | Rotering | |
| 2003/0052940 | A1 | 3/2003 | Aldrich et al. | |
| 2004/0109050 | A1 | 6/2004 | Yang | |

FOREIGN PATENT DOCUMENTS

| | | | |
|---|---|---|---|
| DE | 196 05 014 | C1 | 3/1997 |
| DE | 197 26 642 | C1 | 9/1998 |
| DE | 197 57 653 | A1 | 6/1999 |
| DE | 200 12 946 | U1 | 9/2000 |
| DE | 100 62 012 | A1 | 2/2002 |
| EP | 0 041 706 | A2 | 12/1981 |
| EP | 0 469 619 | A1 | 2/1992 |
| EP | 0 696 509 | B1 | 2/1996 |
| EP | 0 799 135 | B1 | 10/1997 |
| EP | 1 537 998 | A1 | 6/2005 |

* cited by examiner

*Primary Examiner*—Shih-wen Hsieh
(74) *Attorney, Agent, or Firm*—Laurence A. Greenberg; Warner H. Stemer; Ralph E. Locher

(57) ABSTRACT

A device spray cleans an inkjet print head. The purpose of the device is to avoid the formation of stalagmites during spray cleaning and therefore also to improve the print quality as a result of the fact that the transport device for the print carriers or items of mail is soiled as little as possible. This is achieved by a relative movement of a baffle element in a flat space or in a plane parallel to the nozzle surface of the at least one inkjet print head in conjunction with the spray cleaning.

19 Claims, 8 Drawing Sheets

METHOD AND DEVICE FOR SPRAY CLEANING AN INKJET PRINT HEAD

BACKGROUND OF THE INVENTION

Field of the Invention

The invention relates to a method and device for spray cleaning an inkjet print head of an inkjet printing system, in particular in a franking and/or addressing machine or in a mail processing system.

On the one hand, franking machines having inkjet print heads are known, see European patent EP 0 696 509 B1 (corresponding to U.S. Pat. No. 6,390,577) and U.S. Pat. No. 5,806,994, in which the letters are transported lying horizontally and the nozzle surfaces are disposed parallel thereto. In these machines, the nozzles used little or not used during the printing are sprayed clean as long as there is no letter in front of the print head. The ink consumption is reduced in this way. The letter transport device is provided with appropriate recesses and a collecting container for the ink sprayed out is disposed underneath the same. However, this solution is only suitable for the transport of letters lying horizontally.

On the other hand, franking machines of the JETMAIL type from the manufacturer Francotyp Postalia GmbH are known, in which the print carriers or items of mail are conveyed on edge, inclined beyond the vertical for reasons of stability, with the aid of a transport belt; in this regard see German patents DE 196 05 014 C1 (corresponding to U.S. Pat. No. 5,880,747) and DE 197 57 653 C2 (corresponding to U.S. Pat. No. 6,477,511). An item of mail, for example a filled letter envelope, in this case rests behind a clear-view plate on a guide plate, in which a printing window is provided and in which the inkjet print head is disposed in a stationary manner. The letter envelope is led past the printing window and the inkjet print head and printed on the side facing away from the viewer.

The problem of inkjet print head cleaning and sealing is in this case solved by a device for cleaning an inkjet print head, see European patent EP 0 799 135 B1, in which the inkjet print head is fixed such that it can be pivoted alternatively from a printing position into a cleaning position and/or sealing position and back again, and the cleaning and sealing device is disposed such that it can be displaced linearly toward the inkjet print head and away from the latter again.

As an addition to this, a device for positioning an inkjet print head and a cleaning and sealing device are known, see German patent DE 197 26 642 C1 (corresponding to U.S. Pat. No. 6,224,187), in which, for the displacement of the inkjet print head and the cleaning and sealing device, a common gear mechanism is provided which is driven by a motor which runs in only one direction of rotation. The inkjet print head, the cleaning and sealing device and the common gear mechanism including motor are fixed in a common frame and in this way are combined to form a compact subassembly. This subassembly is in turn adjustably fixed to the transport device. The inkjet print head can be pivoted by more than 90° from the printing position into the cleaning position and back again. The cleaning and sealing device is disposed underneath the inkjet print head such that it can be displaced linearly vertically and, during the cleaning operation, is docked on the inkjet print head pivoted downward. Accordingly, the procedure is also the same during spray cleaning. With the solutions described above, the letter transport is interrupted during the cleaning process. If, therefore, an inkjet print head has to be pivoted out of the printing position into the cleaning position and back again through more than 90°, this requires a certain displacement time, during which it is possible neither to frank nor to spray clean. In the event of spray cleaning in the printing position during the transport of the letter envelope, either the latter or the letter transport belt, clear-view plate and the transport belt are noticeably soiled.

It has been proposed in U.S. Pat. No. 6,481,827 B2 to construct the housing of the printing device appropriately with ink absorbers in order to accommodate splashes of ink, in order to restrict the soiling. A further problem occurs in the case of quick-drying inks. When spray cleaning ink into a housing part, after a short time the ink that dries on forms mountains or stalagmites, which are located opposite the nozzles. After some time, these stalagmites can project as far as the nozzles and thus prevent further spray cleaning or cause a nozzle failure during spray cleaning if nozzles are contaminated with dried-on ink. The result is failure of the machine.

A special construction of an ink sump has already been proposed in U.S. Pat. No. 6,644,778 B2. However, in principle, only a sufficiently deep sump functions well. Unfortunately, in the event of a height of the ink sump that is reduced for reasons of space, such a solution cannot be used.

U.S. Pat. No. 6,322,196 B1 discloses an ink service station, containing a container having a blade and a sprung plate, on which adhering ink can form stalagmites until the blade severs the latter. The sprung plate is able to break off at the attachment point and therefore has only a short lifetime. During the undefined shearing of a stalagmite, it is not ensured that the tacky ink residue that is sheared off falls into the sump. It can also adhere close to the spray-cleaning position or to the stalagmite residue in an unplanned manner and then cause the aforementioned problems. In addition, shearing/cutting off the stalagmites with a shearing edge which is moved relative to the ink sump would soil the shearing edge. Alternatively, the sump can be moved relative to the shearing edge, but the stalagmite material sheared off and initially adhering loosely to the shearing edge is difficult to monitor in terms of its subsequent movement. It is therefore possible that this material will move about in the machine and, sooner or later, will arrive at a point where it comes into contact with the print head nozzles and contaminates the latter. The effect is made worse if the drying behavior of the ink residue is known only inaccurately or is variable, for example in the event of changing environmental conditions or the use of different inks, as well as during the transport of the machine.

SUMMARY OF THE INVENTION

It is accordingly an object of the invention to provide a method and a device for spray cleaning an inkjet print head which overcome the above-mentioned disadvantages of the prior art devices and methods of this general type, which has a long, maintenance-free lifetime and which, in spite of spray cleaning which is very frequent in total, avoids the aforementioned disadvantages of the known "shearing off" and "deep ink sump" solutions.

With the foregoing and other objects in view there is provided, in accordance with the invention, a method for spray cleaning an inkjet print head of an inkjet printing system. The method includes performing a relative movement of a baffle element in a flat space or in a plane parallel to a nozzle surface of the inkjet print head in conjunction with a spray cleaning.

In a printing device, in particular in a franking and/or addressing machine or in a mail processing system, in which the print carriers or items of mail are transported past an inkjet print head which is stationary during the printing, and the inkjet print head being arranged in a stationary manner behind a guide plate such that it can be pivoted, and with which, in addition to the usual functions, such as wiping and sealing, spray cleaning during the transport of the print carriers or items of mail is also possible, the intention is for the print carrier transport device or item of mail transport device to be soiled as little as possible.

The object is achieved by a method performing a relative movement of a baffle element in a flat space or in a plane parallel to the nozzle surface of the at least one inkjet print head during spray cleaning. Provision is made for the spray cleaning not to be carried out continually at the same point but at a plurality of points on a baffle element. An ink sump or frame is equipped with a movable baffle element, onto which ink is sprayed clean in a spray-cleaning position. The at least one inkjet print head is moved into a marginally displaced position during, before or after the spray cleaning. By use of the device for spray cleaning an inkjet print head in a printing device, the inkjet print head and the baffle element can be moved freely relative to each other until a spray-cleaning position close to the printing position is reached.

In conjunction with the spray cleaning, the baffle element is moved relative to at least one inkjet print head in a plane parallel to the nozzle surface of the at least one inkjet print head. In a preferred variant, the baffle element is moved after each spray cleaning action. However, the baffle element can also be moved between two spray cleaning operations or during the spray cleaning or before the spray cleaning. In an alternative embodiment, the baffle element is moved onward at the latest after a time period if the height of a stalagmite exceeds a limiting value or threatens to become a problem for the inkjet printing system. Alternatively, only the at least one inkjet print head is moved during the spray cleaning, in order to prevent the stalagmites growing in height. It is also possible for movements of both the baffle element and the at least one inkjet print head to be carried out during the spray cleaning.

Provision is made for a baffle plate to be equipped with a baffle element which has a paper layer or film strip which is moved, during, before or after spray cleaning, the movement being effected by the same drive which moves the inkjet printing module holder and the baffle plate. Provision is also made for a movable baffle element to be a tray or a disk, which is rotatably mounted on the baffle plate and is caused to rotate onward stepwise by a mechanism, the mechanism being driven by the same drive which moves the inkjet printing module holder and the baffle plate. In this case, the space marginally available close to the printing position is utilized optimally.

With the foregoing and other objects in view there is further provided, in accordance with the invention, an inkjet printing system with a device for spray cleaning an inkjet print head. The system includes a guide plate having a printing window, at least one inkjet print head having a surface nozzle and disposed in a stationary manner and can pivot behind the guide plate in the printing window, and a transport device disposed next to the guide plate. On the guide plate a print carrier rests and is guided by the transport device. A cleaning and sealing device is disposed behind the guide plate and is displaceable towards the inkjet print head and away from the inkjet print head. An inkjet printing module holder defines an axis of rotation and holds the at least one inkjet print head. The inkjet print head is moveable in rotation about the axis of rotation which is parallel to a transport direction of the print carrier. A microprocessor controlled motor is provided and the inkjet printing module holder is pivoted under motor drive of the motor into a printing position and a spray-cleaning position. A baffle element is disposed and moveable between the cleaning and sealing device and the inkjet printing module holder. The baffle element is movable relative to the inkjet printing module holder and, during spray cleaning, the baffle element is positioned in a flat space or in a plane parallel to the nozzle surface of the at least one inkjet print head.

Other features which are considered as characteristic for the invention are set forth in the appended claims.

Although the invention is illustrated and described herein as embodied in a method and a device for spray cleaning an inkjet print head, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

A printing or franking machine usually has a transport device for the transport of print carriers on a front side. For example, the transport from left to right of print carriers or items of mail standing on edge is carried out while at least one inkjet print head is positioned fixedly in a printing position. In this regard, franking machines of the JETMAIL type from the manufacturer Francotyp Postalia GmbH are disclosed by German patent Nos. 196 05 014 C1 (corresponding to U.S. Pat. No. 5,889,747) and DE 197 57 653 C2 (corresponding to U.S. Pat. No. 6,477,511), in which the print carriers or items of mail are conveyed with the aid of a transport belt.

Figure 1A:
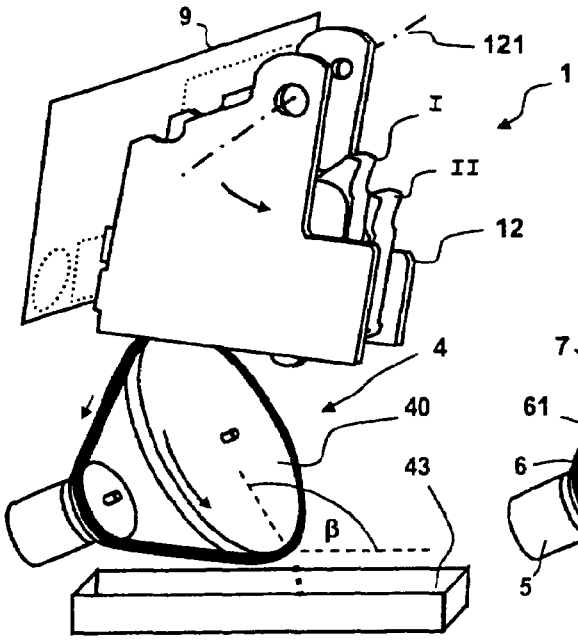
FIG. 1A is a diagrammatic, perspective view of an inkjet printing system from the top rear right of a printing module holder having two inkjet print heads in the printing position, according to a first embodiment of the invention.

Referring now to the figures of the drawing in detail and first, particularly, to FIG. 1A thereof, there is shown a perspective view of an inkjet printing system 1 from the top rear right of a printing module holder 12 having two inkjet print heads in the printing position, according to a first embodiment. For the purpose of simplification and for easy understanding, the illustration is carried out schematically to some extent, that is to say the transport device, chassis, frame and housing have not been illustrated. The nozzle surface of the inkjet print heads in the first embodiment lies parallel to a surface of an item of mail 9 to be printed. Each of the two inkjet print heads is for example incorporated into a postal printing module I or II. Postal printing modules of this type contain an ink tank and an additional memory chip. Details relating to the construction of such postal printing modules and their activation can be gathered from German patent DE 100 36 345 B4 (corresponding to U.S. patent disclosure Nos. 2004/0212653 A1 and 2002/0140755 A1).

Even though, according to FIG. 1A, the inkjet printing system 1 having the printing module holder 12 for two printing modules I, II has been shown, a modified printing module holder for only one printing module 11 or a plurality of the printing modules can likewise be used. The printing module holder 12 is mounted such that it can rotate about an axis of rotation 121 and can be pivoted from the printing position shown into other positions. Disposed between the printing module holder 12 and an ink sump 43 is a movable baffle element 4. The movable baffle element 4 according to the first embodiment is a disk 40, which is mounted centrally. The disk 40 lies on a secant, which intersects the circle of rotation about the axis of rotation 121, on the one hand, and the ink sump 43, on the other hand, in an obtuse angle β.

Figure 1B:
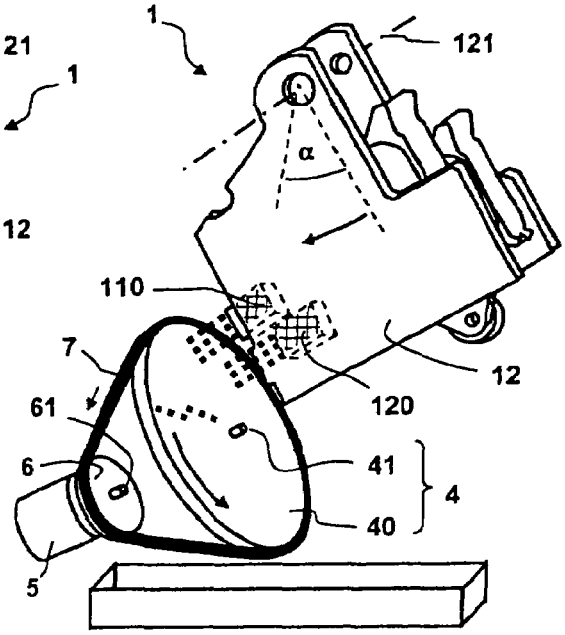
FIG. 1B is a diagrammatic, perspective view of the inkjet printing system from the top rear right of the printing module holder having two inkjet print heads in the spray-cleaning position, according to the first embodiment.

FIG. 1B shows a perspective view of the inkjet printing system 1 from the top rear right of the printing module holder 12 having two inkjet print heads in the spray-cleaning position. The spray-cleaning position is not placed far from the printing position, so that only a slight rotation of the printing module holder 12 is necessary for this purpose. As a result, the spray-cleaning position which is not far from the printing position can be reached much more quickly than a spray-cleaning position close to or in the cleaning and sealing station. Once the printing module holder 12 has been pivoted into the spray-cleaning position not far from the printing position, the disk 40 is disposed approximately parallel to the nozzle surface of the inkjet print heads 110, 120 (shown dashed). The complementary acute angle α which results with respect to the printing position corresponds to the angle of rotation about the axis of rotation 121 during rotation into the spray-cleaning position. The disk 40 is mounted such that it can rotate about a shaft 41 and is driven by a motor 5. The motor 5 with its drive wheel 6 acts indirectly via a belt 7 on the disk 40, which moves in the direction of rotation (arrow). The spray cleaning is therefore carried out on a different point on the disk each time. As a result of distributing the ink to a large number of points on the disk, the critical stalagmite formation is avoided despite a very low overall height. There are no tacky sheared-off stalagmite residues moving about in an undefined manner in the machine. The ink residues are in a fixed location on the disk in a well-defined manner and so thin that they do not interfere. The belt may also be deflected—in a manner not indicated—over deflection rollers in order to participate in a drive force present. For instance, the drive force for the pivoting movement of the printing module holder 12 can also be used to move the disk or another baffle element.

Alternatively, the motor 5 with its drive wheel 6 can act on the disk 40 via a frictional action of a friction lining or via external toothing. For this purpose, appropriate friction linings are applied to the outer edges of the disk 40 and the drive wheel 6, or the disk 40 and the drive wheel 6 are produced with external toothing. A belt can then be omitted.

Figure 2A:
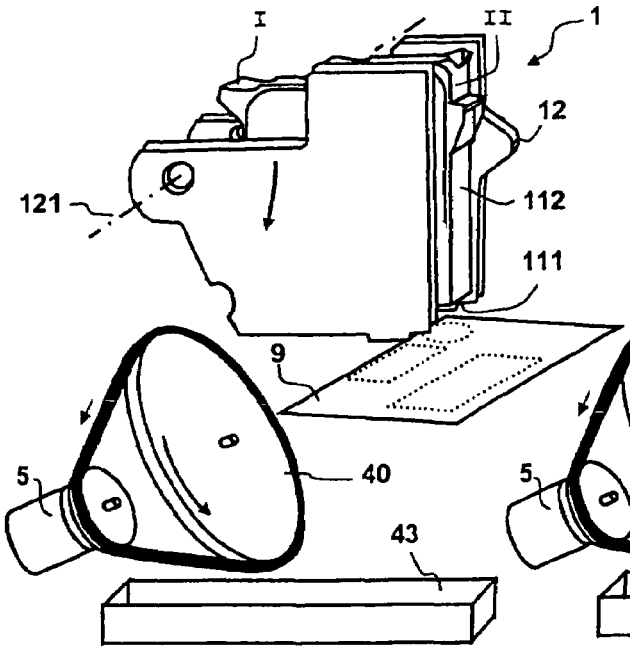
FIG. 2A is a diagrammatic, perspective view of the inkjet printing system on the inkjet printing module holder having two inkjet print heads in the printing position, according to a second embodiment of the invention.

FIG. 2A shows a perspective view of the inkjet printing system 1 on the printing module holder 12 having two inkjet printing heads in the printing position, according to a second embodiment with horizontal transport of print carriers or items of mail 9. As in the first, in the second embodiment the disk 40 is also rotatably mounted and is driven by the motor 5. The inkjet print heads each have a nozzle surface 111 and are again contained in the printing modules I, II. The latter each have a contact surface 112 which comes into contact with non-illustrated contacts in the printing module holder 12 when the printing modules I, II are inserted into the printing module holder 12. In the second embodiment, the nozzle surface of the inkjet print heads is also again located parallel to the surface of an item of mail 9. The printing module holder 12 is again mounted such that it can rotate about an axis of rotation 121 and can be pivoted from the printing position shown into other positions. Once more, the movable baffle element 4 is disposed between the printing module holder 12 and the ink sump 43.

Figure 2B:
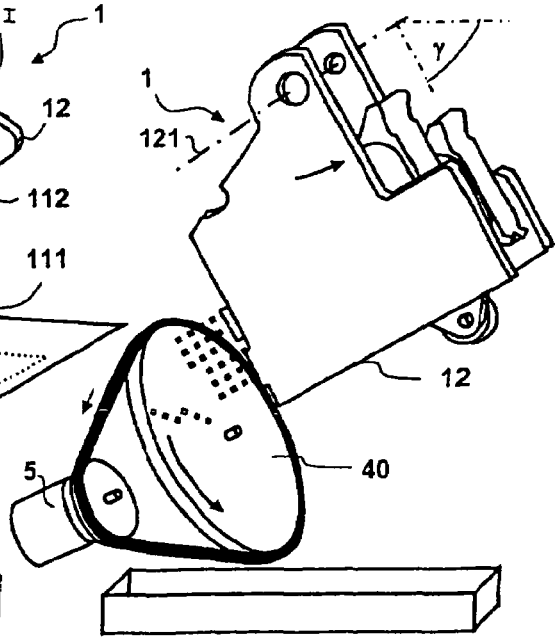
FIG. 2B is a diagrammatic, perspective view of the inkjet printing system of the inkjet printing module holder having two inkjet print heads in the spray-cleaning position, according to the second embodiment.

FIG. 2B shows a perspective view of the inkjet printing system 1 on the printing module holder 12 having two inkjet print heads in the spray-cleaning position, according to the second embodiment with the horizontal transport of horizontal items of mail. The disk 40 is again disposed such that it can rotate and approximately parallel to the nozzle surface of the inkjet print heads and is driven by the motor 5. The complementary acute angle γ resulting with respect to the printing position corresponds to the angle of rotation about the axis of rotation 121 during rotation into the spray-cleaning position. In this case, once more alternative drive mechanisms for producing the rotational movement of the disk 40 are not intended to be ruled out.

Figure 3A:
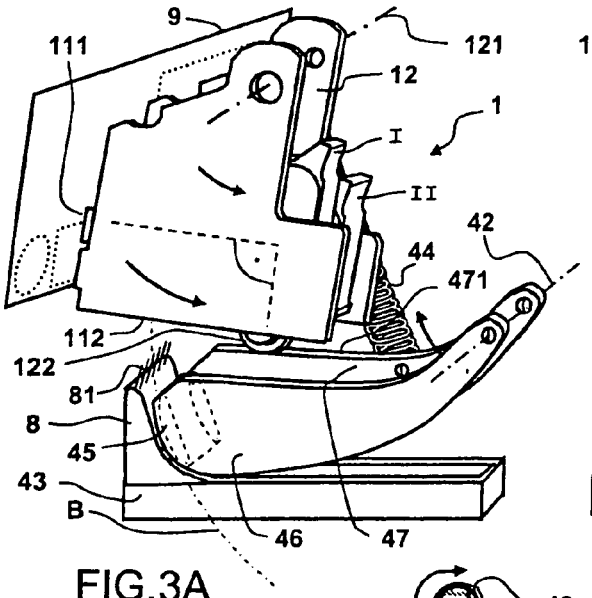
FIG. 3A is a diagrammatic, perspective view of the inkjet printing system from the top rear right of the inkjet printing module holder having two inkjet printing heads in the printing position, according to a third embodiment of the invention.

FIG. 3A shows the perspective view of the inkjet printing system 1 from the top rear right of the printing module holder 12 having two inkjet print heads in the printing position, according to a third embodiment with transport of print carriers or items of mail 9 standing on edge. The third embodiment has the ink sump 43 and the baffle element 4 which—as distinct from the first embodiment according to FIG. 1—is modified, containing a baffle components 45 to 47 that can rotate about an axis of rotation 42 and a tension spring 44. The baffle element 4 has a baffle body 45 (shown dashed) disposed between the swinging ends of two swinging arms 46, 47 and the tension spring 44.

The baffle body 45 (shown dashed) is on an inner side and is located flattened with its opposite outer side like a circular segment on a circular arc B, which can be drawn about a center on the axis of rotation 42. The two other sides of the baffle body 45 are rounded. In each case, one end of the swinging arms 46, 47 is mounted such that it can rotate about the axis of rotation 42. The axis of rotation 42 of the swinging arms 46, 47 and the axis of rotation 121 of the printing module holder 12 for two printing modules I and II lie parallel to one another in the same direction. The printing module holder 12 has a wheel 122 which is fitted on one side of the contact surface 112 of the printing modules I, II and which is disposed at a distance from the nozzle surface 111 and at right angles thereto. The axes of rotation 42 and 121 are mounted invisibly in the frame of the inkjet printing system 1. One end of the tension spring 44 is fixed to the swinging arm 47, and the other end of the tension spring 44 is fixed to the frame. A guide edge 471 of the swinging arm 47 is in contact under spring tension with the wheel 122 of the printing module holder 12. The guide edge 471 of the swinging arm 47 has in one half—close to the axis of rotation 42—an inwardly curved contour which rises toward the two ends of the swinging arm 47. In the printing position shown, this leads to the other half of the swinging arm 47 and, likewise, that of the swinging arm 46 and also the baffle body 45, being forced downward in the direction of the ink sump 43. This takes place as soon as the wheel 122 reaches the other half of the swinging arm 47 and rolls toward the end in the direction of the printing location. A spacer 8 for thrust elements 81 is fixed to that end of the ink sump 43 which points in the direction of the printing location. The thrust elements 81 can, for example, contain a row of bristles, which are preferably produced from plastic.

Figure 3C:
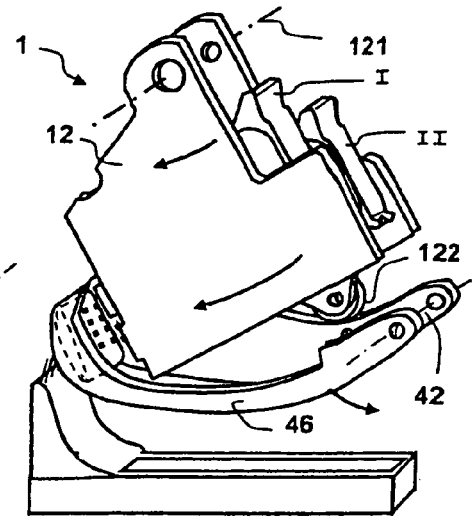
FIG. 3C is a diagrammatic, perspective view of the inkjet printing system from the top rear right of the inkjet printing module holder having two inkjet print heads in the spray-cleaning position, according to the third embodiment.
Figure 3B:
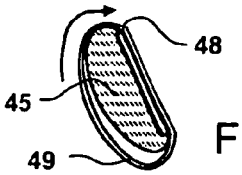
FIG. 3B is a diagrammatic, cross-sectional view through a baffle element.

A cross section through the baffle element 4 is illustrated in FIG. 3B. The baffle element further contains an endless belt 49, which is moved onward in the direction of the arrow over a baffle plate 48 and the baffle body 45 fixed to the latter. The baffle body 45 has an oval cross section and any integrally molded surface. The latter is located on a chord of the circular arc. A cavity corresponding to the dimensions of the baffle plate 48 is machined into the surface. The baffle body 45 is intended to exhibit the lowest possible friction for the endless belt 49 and therefore has a smooth surface and a rounded shape.

FIG. 3C shows a perspective view of the inkjet printing system 1 from the top rear right of the printing module holder 12 having two inkjet print heads in the spray-cleaning position, according to the said embodiment. In order that the baffle element is visible, the right hand swinging arm 46 has been illustrated as cut open. The invisible part of the baffle body 45 is illustrated shown dashed.

The wheel 122 of the printing module holder 12, fitted to the side of the contact surface 112 of the printing modules I, II, is now illustrated as having rolled onto the deepest point of the inwardly curved contour of the guide edge 471. At one end of the ink sump 43, in the duration of the printing location, the spacer 8 for the thrust elements 81 has been moved away from the swinging arms and the baffle body only to such an extent that the latter is not hindered in its movement. The thrust elements 81 cause only slight friction on the endless belt when the baffle body 45, the other half of the swinging arm 46 and, likewise, that of the swinging arm 47, are pulled away from the ink sump 43 upward on account of the spring force of the tension spring 44. The endless belt is not moved further.

However, the thrust elements 81 push the endless belt slightly further as soon as the baffle body 45, the other half of the swinging arm 46 and, likewise, the other half of the swinging arm 47 are forced downward again in the direction of the ink sump 43 by the wheel 122.

Figure 4A:
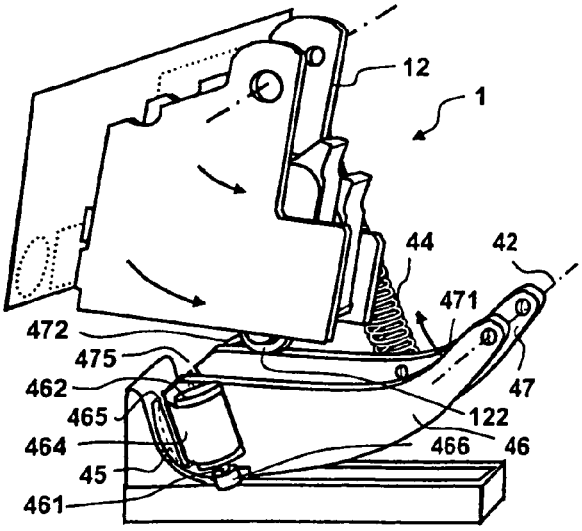
FIG. 4A is a diagrammatic, perspective view of the inkjet printing system from the top rear right of the inkjet printing module holder having two inkjet print heads in the printing position, according to a fourth embodiment of the invention.

FIG. 4A shows a perspective view of the inkjet printing system 1 from the top rear right of the printing module holder 12 having two inkjet print heads in the printing position, according to a fourth embodiment with transport of print carriers or items of mail 9 standing on edge, having the ink sump 43 and having a baffle element 4 that is further modified—as distinct from the third embodiment according to FIG. 1. It also contains the baffle components 45 to 47 that can rotate about the axis of rotation 42 and the tension spring 44. Once more the baffle element 4 has the baffle body 45 (shown dashed) between the two swinging arms and 46, 47. However, leadthrough slots 465, 475 are molded into the ends of the swinging arms 46, 47 in order to lead a film strip 464 through close to the baffle body 45 and along the baffle plate 48. During spray cleaning, no stalagmites can be produced on the film strip 464 moved through. The film strip 464 is moved along on the baffle plate 48 in the transport direction of the items of mail and/or alternatively in the direction opposite thereto. The film strip 464 is driven from the concealed left-hand side in order to move it onward. Suitable for this purpose is, for example, a small electric motor or a mechanism which likewise again uses the energy of the relative movement of print head and spray-cleaning position. The used film sprayed with ink can expediently be rolled up. An unwind roller 462 and winding roller 472, respectively, for the film strip 464 is plugged onto a bearing shaft 461 and 471, respectively, which are fixed close to the swinging end of the swinging arm 46 and 47 by a fixing element 466 and 476. By the spring force, the swinging arm 47 is pressed against the roller 122 and moved in the direction of the ink sump when the printing module holder 12 is pivoted into the printing position.

Figure 4B:
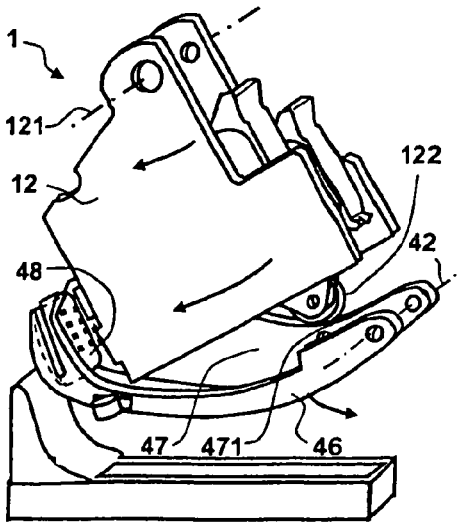
FIG. 4B is a diagrammatic, perspective view of the inkjet printing system from the top rear right of the inkjet printing module holder having two inkjet print heads in the spray-cleaning position, according to the fourth embodiment.

FIG. 4B shows a perspective view of the inkjet printing system 1 from the top rear right on the printing module holder 12 having two inkjet print heads in the spray-cleaning position, according to the fourth embodiment. By rotation about the axis of rotation 121, the roller 122 has been rolled to the deepest part of the inwardly curved contour of the guide edge 471 of the swinging arm 47, in order to reach the spray-cleaning position. As a result, the tension spring 44 with which the swinging arm 47 is kept under spring tension is concealed. Nevertheless, one end of the tension spring 44 continues to be fixed to the swinging arm 47 and the other end of the tension spring 44 to the frame. The swinging arm 46 that can rotate about the axis of rotation 42 has been illustrated cut open to some extent, in order that the baffle plate 48 becomes visible. The details of the film or paper web movement mechanism have been left out for reasons of improved clarity. The used film can alternatively also be folded into or stuffed into a replaceable container—not shown—for used material, for example into a plug cartridge. Instead of the film, a paper web, which is advantageously recyclable, can also be used.

The movable element is, on the one hand, a rotatable tray in particular with a replaceable recyclable paper disk, or, on the other hand, the movable element is a film or paper web which can be moved with respect to the nozzles, close to the ink sump in a localized manner in the transport direction or orthogonal thereto and which is transported onward from time to time by pawl and ratchet system, freewheel roller, magnet or motor.

Figure 5A:
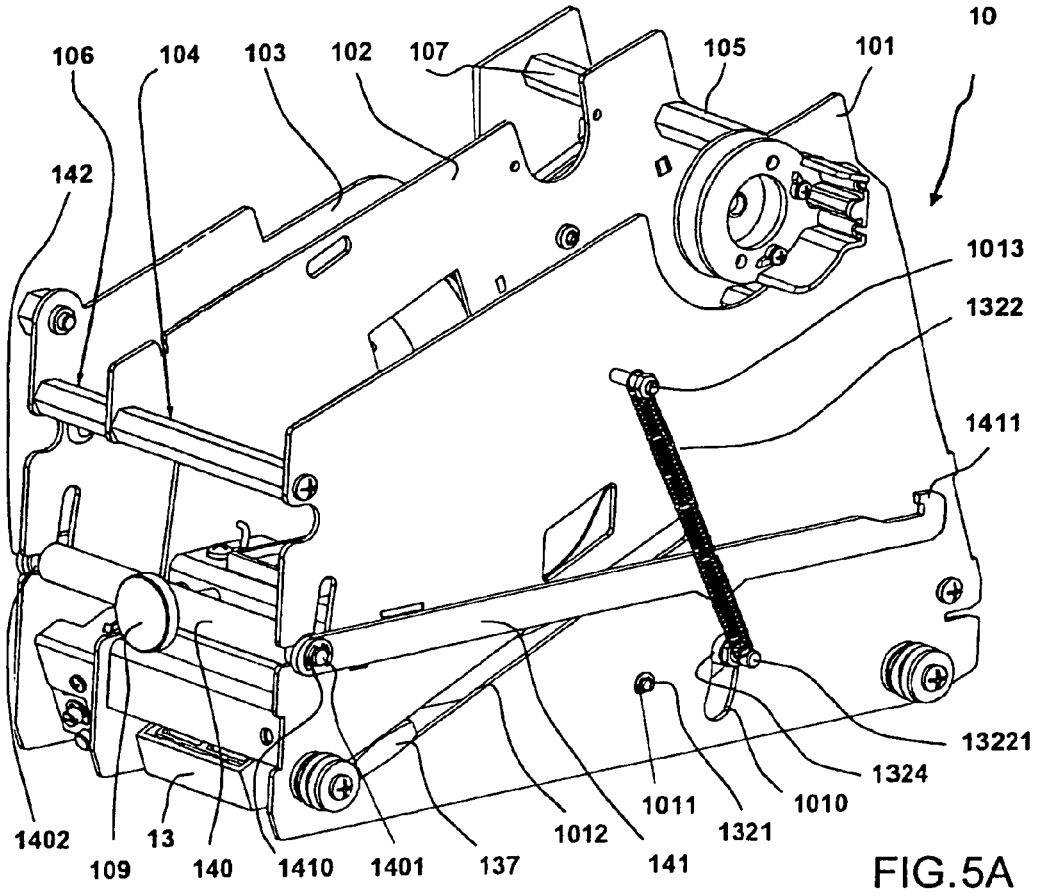
FIG. 5A is a diagrammatic, top rear left perspective view of the frame of an inkjet printing system with a cleaning and sealing device, according to the third, fourth and a preferred fifth embodiment.

FIG. 5A shows a perspective view of the frame of the inkjet printing system with a cleaning and sealing device from the top rear left, according to the third, fourth and a preferred fifth embodiment. In a lower part of the frame, the cleaning and sealing device 13 for the inkjet print heads 110, 120 is incorporated. An inkjet print head and ink tank are in each case a constituent part of an inkjet printing module 11.

The upper part of the frame 10 is illustrated without the devices incorporated inside for holding the two inkjet printing modules I and II. A first wall plate 101 on the left in the frame 10, and a second wall plate 102 in the center of the frame 10 are screwed to each another via spacers 104, 105. The second wall plate 102 in the center of the frame 10 is screwed at a shorter distance to a third wall plate 103 on the right in the frame 10 via spacers 106, 107. Centrally in the upper part, the first wall plate 101 has a pin 1013 projecting outward on the left for the fixing of a tension spring 1322. The first wall plate 101 has a drilled hole 1011 for a rotary pin 1321 and a slot 1010 in the form of part of a circular arc for a rubber sleeve 1324. A fixing pin 13221 belonging to a baffle plate 132 (not visible) and which is rotatably mounted in the drilled hole 1011 by its rotary pin 1321, sticks into a rubber sleeve 1324. A tension spring 1322 is hooked at both ends to the pin 1013 and to the fixing pin. The frame 10 is fixed to a non-illustrated chassis via a fixing device 14, containing a detachable tension piece 140 and two tie rods 141 and 142. The detachable tension piece 140 for two tie rods 141 and 142 extends on the rear side of the frame having the pins 1401 and 1402 beyond the first wall plate 101 and third wall plate 103 as far as the tie rods 141 and 142, which bear loosely on the outer side of the wall plates 101 and 103 and at one end are each rotatably fixed to one of the pins. For the purpose of rotatable mounting, in each case use is made, for example, of a hole at the end of the tie rod 141 and 142 for the pins 1401 and 1402 and, for the fixing, in each case a securing washer 1410 and 1420 (not visible) on the pin. At the other end of the tie rod 141 and 142, in each case a hook 1411 and 1421 is formed, which in each case hooks into an eye in the chassis. A fixing screw 109 in the center of the detachable tension piece 140 permits easier tightening of the frame 10 to the chassis during fixing.

Means which are fixed to a carriage 137 belong to the cleaning and sealing device 13 in the lower part of the frame 10. The carriage 137 is disposed in a second slot 1012 in the first wall plate on the left of the frame and—not visible—in a third slot in the second wall plate in the center of the frame and can be displaced rectilinearly. The two slots extend on the respective wall plates from the rear side of the frame downward at least as far as the center of the frame. By using FIG. 10, it will be explained below that the carriage 137 is displaced from the initial position shown in FIGS. 5, 8 and 9 obliquely upward as far as the center of the frame 10 in order that the two inkjet print heads bear on the sealing station of the cleaning and sealing device 13 when in the spray-cleaning position. The above-mentioned but invisible baffle plate 132 belongs to the cleaning and sealing device 13.

Figure 5B:
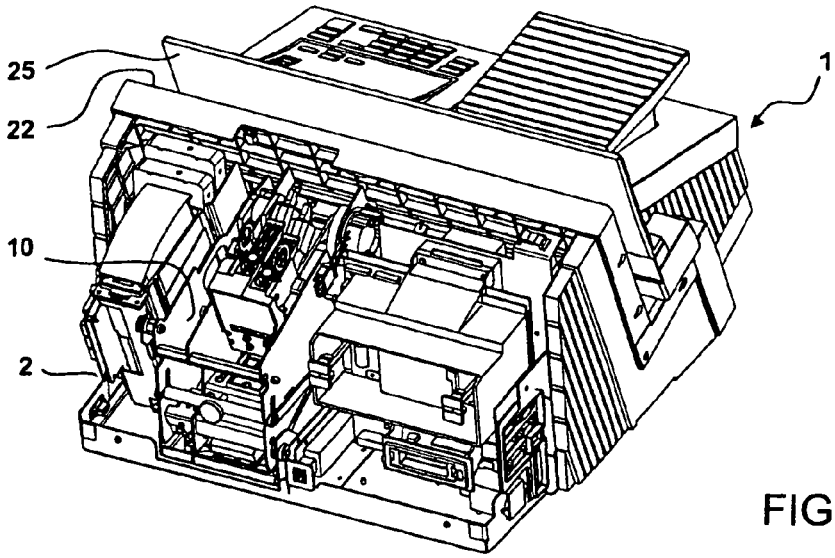
FIG. 5B is a diagrammatic, perspective view of the inkjet printing system from the top rear left, with the housing rear wall open.

In FIG. 5B, a perspective view of an inkjet printing system is illustrated from the top rear left with the housing rear wall opened. The aforementioned frame 10 is fixed to a chassis (not visible) by a form fit. In this case, parallelism between transport direction and printing lines is achieved. The chassis carries the transport device 2 which is comparable with the JETMAIL franking machine and which is driven invisibly by a motor disposed on the right-hand side of the inkjet printing system in the vicinity of the base. In the frame 10, at least one inkjet print head is disposed in a stationary manner but pivotably behind a guide plate, which has the printing window. In the printing position, the at least one inkjet print head is positioned in the printing window. A spray-cleaning position is disposed so close to the printing position that the time for moving the at least one inkjet print head into the spray-cleaning position and back again into the printing position is shortest as compared with the other positions. Disposed on the left-hand side of the inkjet printing system is a microprocessor controller. The inkjet printing system is, for example, a franking machine, which is equipped with a plexiglass plate 25 as a safeguard against contact and with a guide plate 22 for items of mail, which are inclined beyond the vertical so that the items of mail rest on the guide plate 22.

Figures 6A, 6B:
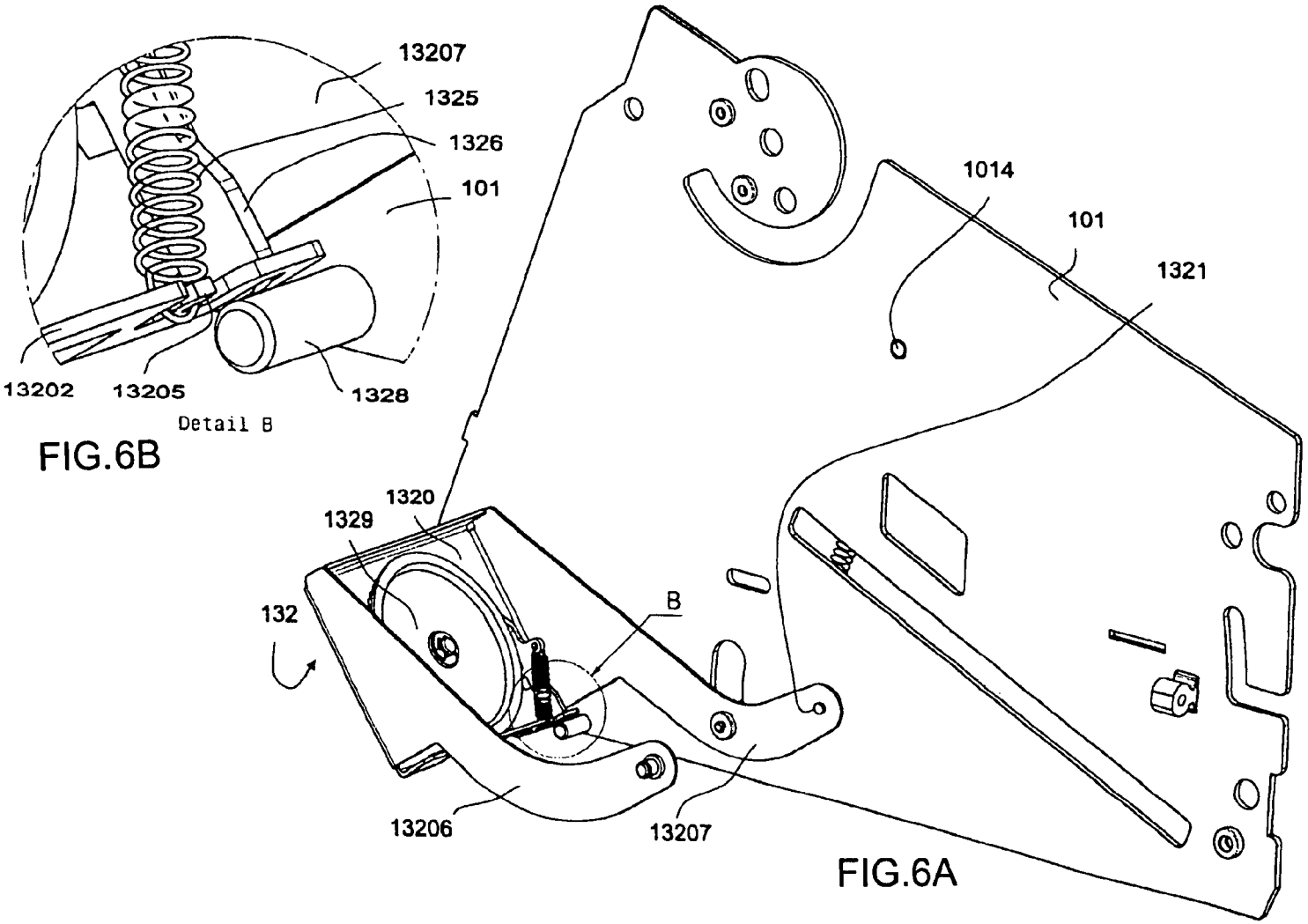
FIG. 6A is a diagrammatic, perspective view from the top rear right of a baffle plate and its arrangement on the first wall plate of the frame, according to a preferred embodiment.
FIG. 6B is a diagrammatic, detail perspective view of the baffle plate according to the preferred embodiment.

In FIG. 6A, a perspective view of the baffle plate 132 and its arrangement on the first wall plate 101 of the frame according to the preferred embodiment is illustrated from the top rear right. Disposed in the first wall plate 101 is a hole 1014 which is intended to hold a pin. In addition a hole is disposed in the first wall plate 101, which is intended to hold a left-hand rotary pin 1321 of a left-hand side swinging arm 13207 of the baffle plate such that the pin can rotate. A right-hand side swinging arm 13206 of the baffle plate and the left-hand side swinging arm 13207 of the baffle plate are firmly connected to each other via a baffle plate base 1320. Disposed centrally on the baffle plate base 1320 is a rotary plate 1329, which is configured to accommodate ink splashes. The arrangement of the baffle plate 132 is illustrated as stopped with an element of the first wall plate 101, the stop being reached in the printing position. The stop will be explained in detail below.

In FIG. 6B, a detail B of the perspective view of the baffle plate according to the preferred embodiment is illustrated. A stop pin 1328 for the baffle plate 132 is firmly connected mechanically to the first wall plate 101. The baffle plate base 1320 has a rear edge 13202, which comes to a stop on the stop pin 1328. The stop is disposed in the region close to the left-hand side swinging arm 13207 and the baffle plate base 1320. In the aforementioned region, a lever 1326 is disposed such it can be displaced and, when it strikes the stop pin 1328, can be moved counter to the force of the spring 1325 until the rear edge 13202 strikes the stop pin 1328.

Figure 7B:
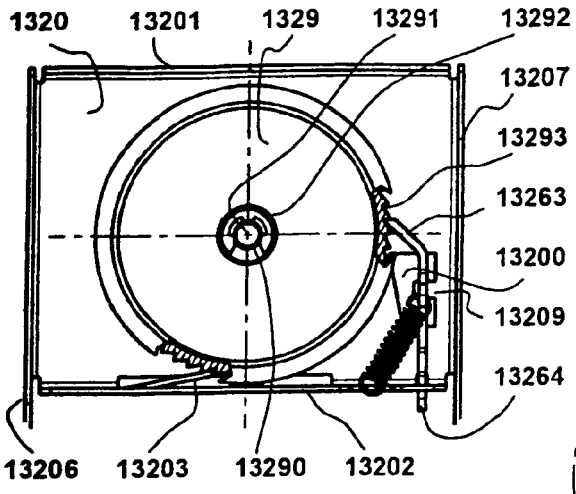
FIG. 7B is a diagrammatic, view of a base of the baffle plate according to the preferred embodiment.
Figure 7C:
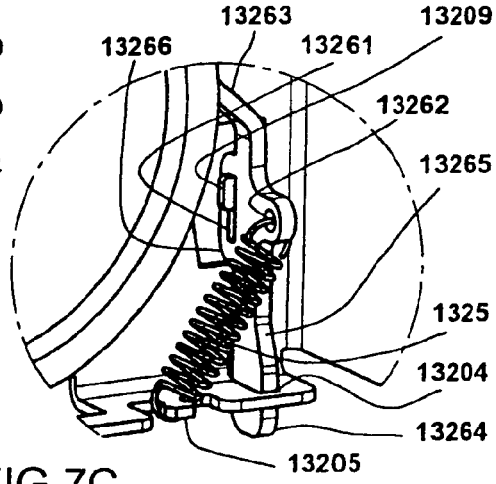
FIG. 7C is a diagrammatic, detail perspective view of the baffle plate according to the preferred embodiment.
Figure 7A:
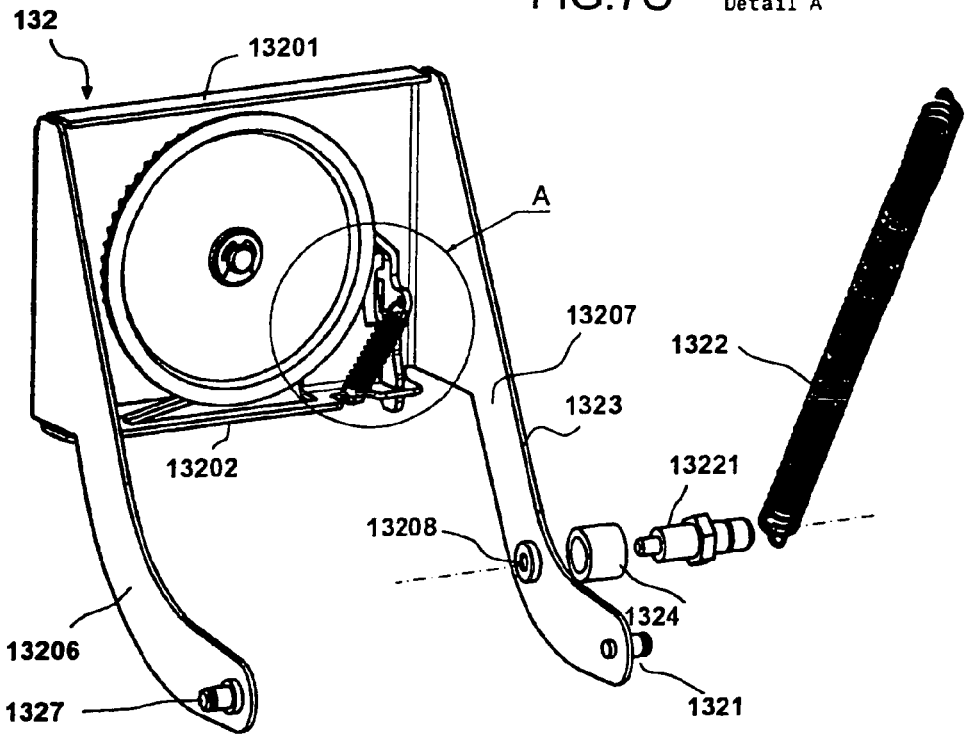
FIG. 7A is a diagrammatic, exploded perspective view from the top rear right of the baffle plate, a tension spring and its fixing to the baffle plate, according to the preferred embodiment.

In FIG. 7A, an exploded perspective view of the baffle plate, a tension spring and its fixing to the baffle plate according to the preferred embodiment is illustrated from the top rear right, the frame having been left out. For example, during the production of the baffle plate 132, all the parts are shaped from a piece of sheet metal and, in the process, the aforementioned side swinging arms 13206 and 13207 and a front edge 13201 and the rear edge 13202 of the piece of sheet metal are bent into the orthogonal position shown with respect to the baffle plate 1320. The right-hand side swinging arm 13206 of the baffle plate and the left-hand side swinging arm 13207 of the baffle plate have rotary pins 1327 and 1221 on the pivot of the swinging arms. The swinging arms are boomerangshaped parts with an inwardly curved contour which can serve as a slotted guide. An upwardly pointing edge of the left-hand side swinging arm 13207 of the baffle plate serves as a guide edge 1323. A hole 13208 is provided in the left-hand side swinging arm for the fixing pin 13221. The hole 13208 lies close to the center of a half of the swinging arm which is closest to the axis of rotation. The fixing pin 13221 is used to fix one end of the tension spring 1322. The perspective view of the tension spring 1322 and its fixing to the baffle plate is illustrated in exploded form. In order to fix the fixing pin 13221 to the limb of the left-hand swinging arm 13207, a thread in the hole 13208 is used. The fixing pin 13221 is surrounded by a rubber sleeve 1324 which is plugged on and which has a noise-damping action when the baffle plate 132 reaches an end position.

The view of the baffle plate base 1320 shown in FIG. 7B is intended to serve to explain the drive of the rotary plate 1329 of the baffle plate 132 according to the preferred embodiment. The baffle plate base 1320 is delimited by the swinging arms 13206 and 13207 and also by the front edge 13201 and rear edge 13202 of the baffle plate. The rotary plate 1329 has a hole 13290 at its center and is rotatably mounted on a bearing pin 13291. The bearing pin 13291 is fixed in the center of the baffle plate base 1320. The fixing is produced by riveting, for example. The hole 13290 in the center is partly concealed by a securing washer 13292. Toothing 13293 of the rotary plate is moved a little under the mechanical action by the angled-over end 13263 of the lever 1326 when the lever 1326 is moved when it is stopped on the stop pin 1328. In this case, an end 13264 of the lever which is not angled over is moved in the direction of the rear edge of the baffle plate. At the same time, a sprung pawl 13203 latches into the toothing 13293 of the rotary plate, so that a reverse movement is prevented. The sprung pawl 13203 and a tension spring and an opening for the end 13264 of the lever that is not bent over can be fixed and mounted on and respectively machined into the rear edge 13202 of the baffle plate base. At least one c-shaped opening 13200 in the baffle plate base 1320 and corresponding further openings are punched into the rear edge 13202 as the sheet metal piece is shaped. The sprung pawl 13203 can be produced from the rear edge 13202 by punching, and the lever 1326 can be punched out of the aforementioned piece of sheet metal. The lever 1326 is angled over by about 45° at its one end 13263 and likewise has a shape produced by punching out with an opening, likewise produced by punching out, into which, after it has been mounted, there projects a lug which is formed by the central part 13209 in the c-shaped opening 13200.

A detail A of the perspective view of the baffle plate according to the preferred embodiment is illustrated in FIG. 7C. On the narrow side facing away from the baffle plate base 1320, close to the angled-over end 13263 of the lever 1326, the lever has a fixing opening 13262 for one end of a tension spring 1325 and an indentation 13265 close to the end 13264 of the lever 1326 that is not angled over. The lever has a bulge 13266 on the narrow side facing the baffle plate base 1320. The opening produced centrally in the lever, for example in the bulge 13266, by the punching out has the shape of a slot 13261. The lever 1326 is inserted with its bulge 13266 in the manner shown into the c-shaped opening 13200 in the baffle plate base 1320. It is thus disposed such that it can move on the central part 13209 of the baffle plate base projecting into the c-shaped opening and can therefore be used as a drive and locking pawl for the rotary plate 1329.

One end of the tension spring 1325 is hooked into the fixing opening 13262 of the lever 1326. A fixing anchor 13205 is punched out on the rear edge 13202 of the baffle plate base 1320 between the guide opening 13204 and the sprung pawl 13203 and is used to hook in the other end of the tension spring 1325.

A guide opening 13204 for the lever 1326 has also been punched out of the rear edge 13202. The guide opening 13204 has a form of a slot, which means that the lever is guided at its end 13264 that is not angled over with its flat side orthogonal to the baffle plate base 1320 and approximately orthogonal to the rear edge 13202 of the baffle plate base 1320. By the tension spring 1325, the angled-over end 13263 of the lever 1326 is deflected in the direction of the rotary plate edge and comes into engagement with the toothing. The maximum circumference of the rotary plate 1329 is limited by the edges of the baffle plate base 1320.

Figures 8A, 8B:
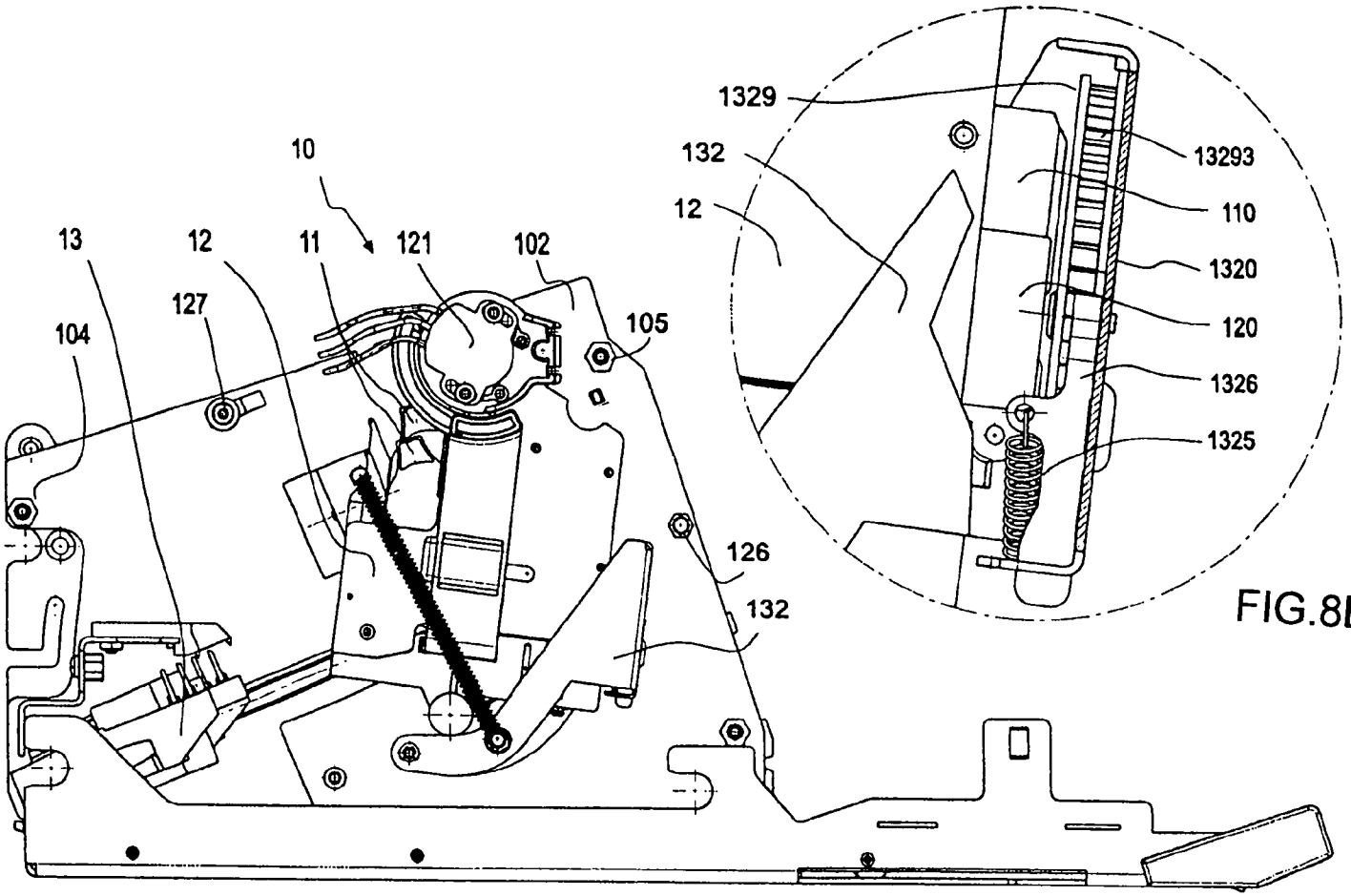
FIG. 8A is a diagrammatic, vertical cross-sectional view through the inkjet printing system with a side view from the left of an inkjet printing module holder having two inkjet print heads in the spray-cleaning position on the baffle plate.
FIG. 8B is a diagrammatic, detailed side view of the baffle plate according to the preferred embodiment.

A vertical cross section through the inkjet printing system with a side view from the left of an inkjet printing module holder having two inkjet print heads in the spray-cleaning position on the baffle plate is shown in FIG. 8A. For reasons of improved illustration of the details, the first wall plate has been left out of FIG. 8A. The inkjet printing module holder 12 is configured to hold at least one inkjet printing module 11. An inkjet printing module 11 has at least one ink tank and an inkjet print head. Suitable inkjet printing modules 11 are, for example, ½-inch ink cartridges from Hewlett-Packard, which are equipped with an additional memory chip by Francotyp-Postalia GmbH. The inkjet printing module holder 12 is disposed above the cleaning and sealing devices 13 in the frame 10 such that it can pivot about an axis of rotation 121. A first stop 126 on the second wall plate 102 is reached by the inkjet printing module holder 12 in the printing position. The inkjet printing module holder 12 having two inkjet printing modules 11 can be pivoted out of the printing position into the spray-cleaning position illustrated or into other positions. Another position is, for example, a change position—not shown—in which the inkjet printing module holder 12 is pivoted rearward and upward by more than 90°. The inkjet printing module holder 11 can be replaced only in the change position. In order to move the inkjet printing module holder 12 into the change position, an extremely long time is needed relative to the other positions until the inkjet printing module holder 12 reaches a stop 127. A further stop 127 on the second wall plate 102 of the frame 10 is disposed such that it can be adjusted and fixed and is assumed to be the outermost position after the cleaning region. The movement space of the inkjet printing module holder 12 lies within the interior of the frame 10, bounded laterally by the spacers 104, 105 for the wall plates and at the bottom by the ink sump 133. The inkjet print heads 110, 120 are concealed by the baffle plate 132 and are therefore illustrated as a detail in FIG. 8B.

A detail of the side view of the baffle plate according to the preferred embodiment is illustrated in FIG. 8B. The baffle plate 132 is shown cut open. The movable baffle element is a tray-shaped disk 1329, which is mounted centrally on the baffle plate base 1320. It is arranged in such a way that the action of spray cleaning the inkjet print heads 110, 120 is carried out close to the edge of the disk. On the circumference, the desk has toothing 13293, in which the lever 1326 engages and operates as a locking pawl. The lever is fitted to the baffle plate in such a way that, on account of the action of the tension spring, it does not carry out any relative movement while moving into the spray-cleaning position. However, as it moves into the printing position, by interaction of the lever (locking pawl) moving relative to the disk with the toothing of the disk, the tray-shaped disk 1329 is rotated onward a little each time and spray cleaning is thus carried out each time at another point on the disk surface. As a result of distributing the ink to the large number of points on the disk, the critical stalagmite formation is avoided despite a very low overall height. There are no sheared-off stalagmite residues moving about in an undefined manner in the machine. The ink residues are fixed in a well-defined manner and also such that they do not interfere. An extremely short time relative to the other positions is needed to move the ink jet printing module holder 12 from the printing position into the spray-cleaning position on the baffle plate.

Figures 9A, 9B:
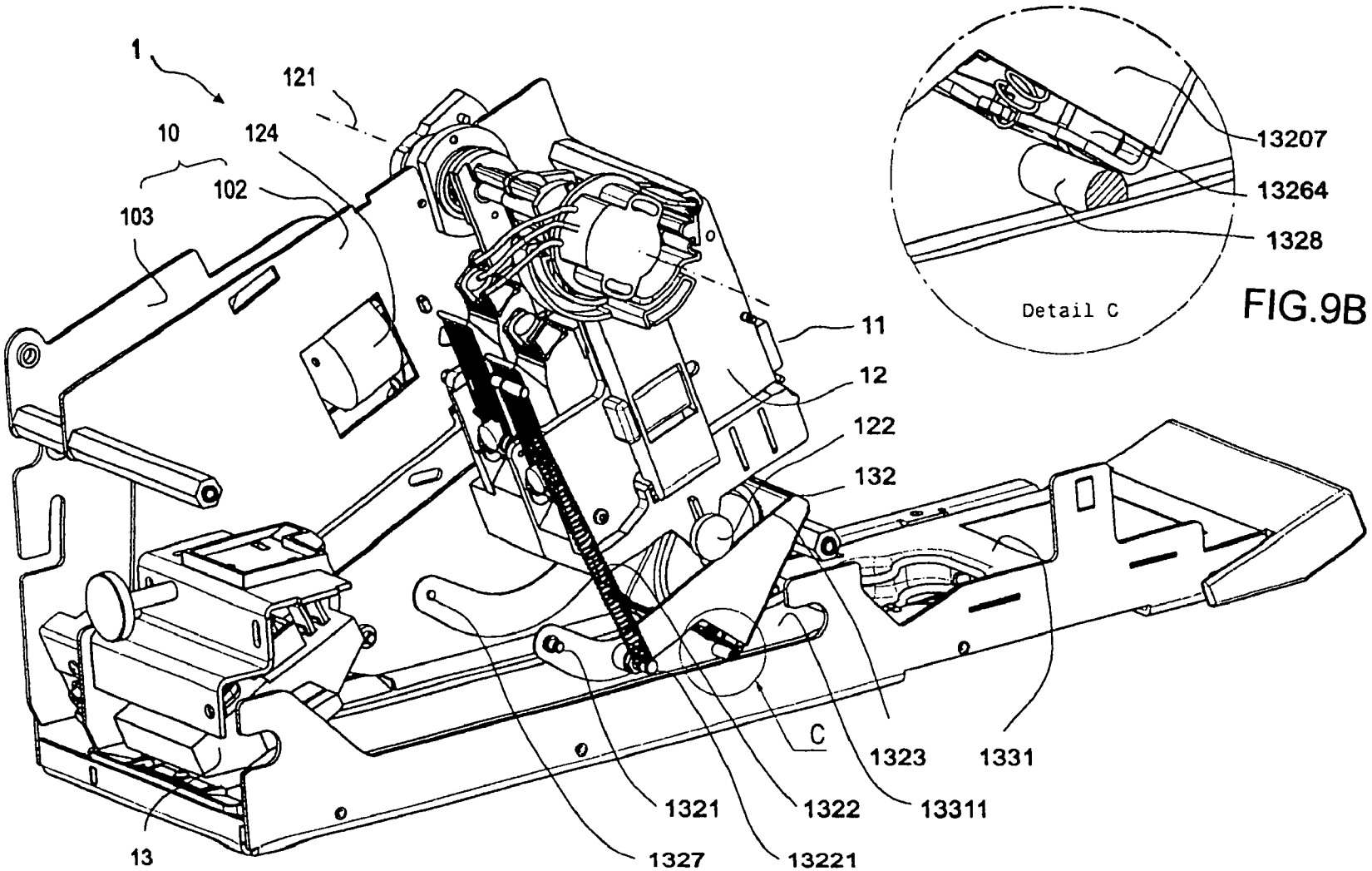
FIG. 9A is a diagrammatic, perspective view through the inkjet printing system from the left of an inkjet printing module holder having two inkjet print heads in the printing position.
FIG. 9B is a diagrammatic, detail perspective view of the baffle plate according to the preferred embodiment.

A vertical cross section through the inkjet printing system with a side view from the left of an inkjet printing module holder 12 having two inkjet print heads in the printing position is shown in FIG. 9A. For reasons of improved illustration of the details, the first wall plate has likewise been left out of FIG. 9A. The inkjet printing system 1 has an inkjet printing module holder 12 that can be pivoted in the frame 10. To displace the inkjet printing module holder 12, at least one actuating motor 124 and a rotary encoder 125 for feedback are connected to a non-illustrated microprocessor controller. In order to set the different functional positions—in a manner not shown—in each case a gearbox for the inkjet printing module holder 12 having the two inkjet printing modules 11 and for the cleaning and sealing device 13 is provided between the second and third wall plate 103 of the frame 10. The gearbox of the inkjet printing module holder 12 is driven by the actuating motor 124. The baffle plate 132 is fixed to the first wall plate and to the second wall plate 102 by rotary pins 1321 and 1327 such that it can rotate. A wheel 122 is fixed to the inkjet printing module holder 12 such that it can rotate, and a guide edge 1323 is integrally molded on a side swinging arm of the baffle plate 132. The baffle plate 132 is connected to the frame 10 via a tension spring 1322, which prestresses the baffle plate 132, which results in that the wheel 122 bears on the guide edge 1323 with a force fit. Mounted on the baffle plate 132 is a fixing pin 13221, which is connected to one end of the tension spring 1322. The wheel 122, the guide edge 1323 and the tension spring 1322 form a slotted guide for the baffle plate 132. The guide edge 1323 is preferably formed on the left-hand side swinging arm of the baffle plate 132. As a result of the movement of the inkjet printing module holder 12, the inkjet print heads are pivoted into the printing position and the baffle plate 132 is lowered. This takes place counter to the action of the tension spring 1322, a wheel 122 mounted on the inkjet printing module holder 12 engaging with a guide edge 1323 of the left-hand side swinging arm of the baffle plate 132 and being moved toward the freely swinging end of the swinging arm until the fixing pin 13221 reaches an upper stop in the slot 1010, which is illustrated in FIG. 5. A withdrawable part 1331 is provided underneath the cleaning and sealing device 13 to hold a nonwoven 13311.

A detail of the perspective view of the baffle plate according to the preferred embodiment as it strikes the stop is illustrated in FIG. 9B. The lower stop 1328 is fixed to the first wall plate in the manner shown in FIG. 6B. Stopping is carried out on the lever end 13264 that is not angled over on the rear edge of the baffle plate base close to the left-hand side swinging arm 13207. The stopping action therefore moves the lever 1326 and thus rotates the tray-shaped disk onward by an amount determined by the tooth size.

Figure 10:
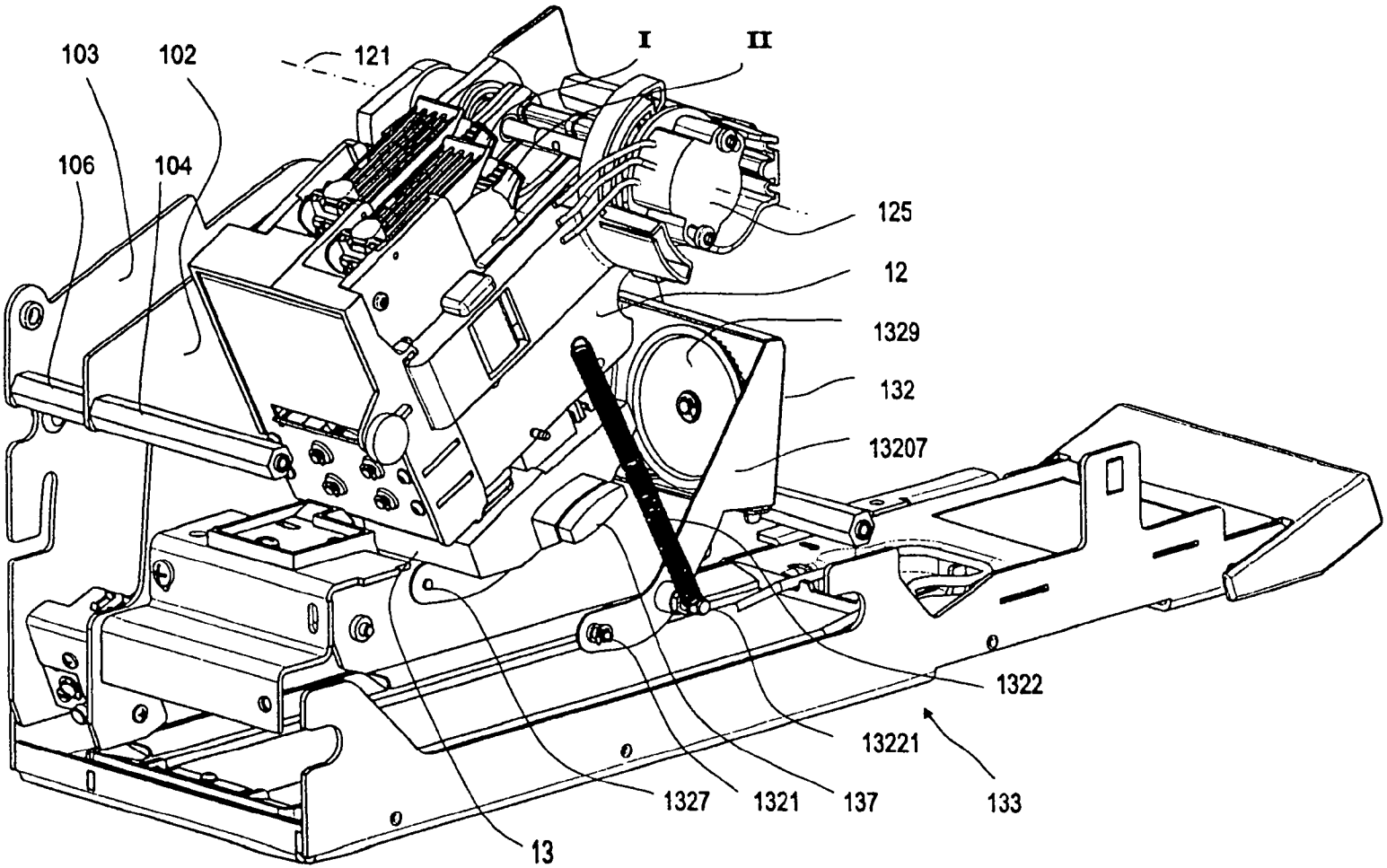
FIG. 10 is a diagrammatic, vertical cross-sectional perspective view through the inkjet printing system with a side view from the left of an inkjet printed module holder having two inkjet print heads in the sealing position on the sealing station.

A vertical cross section through the inkjet printing system with a side view from the left of an inkjet printing module holder having two inkjet print heads in the sealing position on the sealing station is illustrated in FIG. 10. Between the first and second wall plates 102 of the frame and between the second and third wall plates 103 of the frame there are arranged rear spacers 106, 104. The first wall plate has likewise been left out of FIG. 10 as well for reasons of improved illustration of the details. The inkjet module holder 12 is disposed between the first and second wall plates 102 of the frame and can pivot about the axis of rotation 121. The latter lies above the rear spacers 104, 106 and close to and above the (concealed) front spacers. Provision is made for the cleaning and sealing device 13 and an appropriately adapted baffle element, preferably a baffle plate 132 having a tray-shaped disc 1329, to be disposed underneath the inkjet printing module holder 12. The cleaning and sealing device 13 is disposed such that it can be displaced vertically in the frame. For this purpose, use is made in particular of slots running obliquely between the rear end of the ink sump 133 and the aforementioned front spacers in the first and second wall plate 102, and a carriage 137 which can be moved obliquely upward from the rear side of the frame at the bottom toward the center of the wall plates of the frame. On account of the tension spring 1322 acting via the fixing pin 13221, the baffle plate 132 is rotated about the rotary pins 1321, 1327 and again assumes an identical position to that in the spray-cleaning position. In order to move the inkjet printing module holder 12 from the printing position into the sealing position on the sealing station, a longer time is needed as compared with the spray-cleaning position on the baffle plate. The ink sump 133 underneath the cleaning and sealing device 13 is formed as a withdrawable part.

It is particularly advantageous that the inkjet printing module holder having two inkjet printing modules I, II can be pivoted under motor drive and microprocessor control optionally into a printing position, a spray-cleaning position on the baffle element or into various cleaning regions and also into a sealing position, it having been possible to maintain a predefined overall height of the entire inkjet printing system. Therefore, a transport device identical with the JETMAIL franking machine with a guide plate for items of mail could be used, which has a long maintenance-free lifetime and which does not soil, despite a spray cleaning action that is very frequent in total.

As already stated, the baffle elements can be used advantageously both in embodiments of the inkjet printing system having vertical and horizontal transport of print carriers or items of mail. Partial features of the variants can be used combined in a suitable way in variants which are not all to be listed individually.

Nor is the intention to rule out as a solution the variants according to which the at least one inkjet print head is moved into a minimally offset position during, before or after the spray cleaning. The baffle element then does not need to be moved at all in order that the ink jet strikes a different point. The device is then based on a variant similar to the first, second, third or to the preferred fifth exemplary embodiment, only the measures for moving the baffle element being omitted. For example, in the spray-cleaning position, a shaft of a stepping motor moves on step-by-step by a small angle during the spray cleaning. During each step, this corresponds to a very small rotational angle (minutes) of the inkjet printer module holder 12 fixed into the shaft. Via a spindle gear mechanism and gear wheel, the aforementioned shaft drives a further shaft, which lies on the axis of rotation 121 and a rotary encoder 125 also being fixed to the shaft. The rotary encoder, for example of the PMR 403 or PMR 411 type, contains a potentiometer with a rotatable wiper and permits a virtually infinitely high resolution of the useful angle $\alpha$ reached in the angular range $0° < \alpha < 95 \pm 3°$.

A constant voltage is applied to the potentiometer and, using the rotatable wiper, a partial voltage is tapped off, which is fed to an A/D converter. The A/D converter can be present integrated into the microprocessor. The microprocessor controls a stepping motor which rotates the inkjet printing module holder 12 via the gearbox. In this case, stalagmite growth is already prevented by a relative movement between the baffle plate and the inkjet print head. A paper disk placed on the baffle element therefore does not need to be circular either but remains configured such that it can be replaced easily. A replaceable paper disk is fixed to the baffle element by clamps, for example.

However, the intention is not to rule out either the variants according to which the at least one inkjet print head and the baffle elements are all moved into a minimally offset position during, before or after the spray cleaning. Provision is made for the actuating motor 124 to be driven by the microprocessor controller in such a way that the baffle plate 132 is moved by displacing the inkjet printing module holder 12 such that the tray-shaped disk 1329 is rotated into a different position when the baffle plate 132 strikes a stop 1328 and, in addition, the shaft of the actuating motor 124 is moved onward during the spray cleaning, so that the inkjet print head is moved onward into the spray-cleaning position relative to the baffle plate. Therefore, if the inkjet print heads are moved onward by about 0.5 to 2 cm relative to the baffle plate, the period of use can be doubled, for example, with respect to the first, second, fourth and fifth cited variants.

The invention is not restricted to the present embodiments. Thus, further other implementations of the invention can be developed and used which, based on the same basic idea of the invention, are covered by the appended claims.

This application claims the priority, under 35 U.S.C. §119, of German application DE 10 2005 052 151.7, filed Nov. 2, 2005; the prior application is herewith incorporated by reference in its entirety.

We claim:

1. A method for spray cleaning an inkjet print head of an inkjet printing system, which comprises the steps of:

performing a relative movement of a baffle element in a flat space or in a plane parallel to a nozzle surface of the inkjet print head in conjunction with a spray cleaning; and moving the baffle element onward at a latest after a time period if a height of a stalagmite exceeds a limiting value or threatens to become a problem for the inkjet printing system.

2. A method for spray cleaning an inkjet print head of an inkjet printing system, which comprises the steps of:

performing a relative movement of a baffle element in a flat space or in a plane parallel to a nozzle surface of the inkjet print head in conjunction with a spray cleaning; and moving the inkjet print head during the spray cleaning.

3. The method according to claim 2, which further comprises moving the baffle element between two spray cleaning operations or before or after each spray cleaning action.

4. The method according to claim 2, which further comprises moving the baffle element during the spray cleaning.

5. The method according to claim 4, which further comprises moving the baffle element orthogonally with respect to a transport direction of a transported item.

6. The method according to claim 4, which further comprises:

moving the baffle element orthogonally with respect to a transport direction of a transported item; and rotating a disk in the flat space or in the plane parallel to the nozzle surface of the inkjet print head.

7. The method according to claim 2, which further comprises moving a paper layer or film strip of the baffle element during, before or after the spray cleaning.

8. The method according to claim 7, which further comprises moving the paper layer or the film strip orthogonally with respect to a transport direction of a transported item.

9. An inkjet printing system with a device for spray cleaning an inkjet print head, comprising:

a guide plate having a printing window formed therein;

at least one inkjet print head having a surface nozzle and disposed in a stationary manner and can pivot behind said guide plate in said printing window;

a transport device disposed next to said guide plate, on said guide plate a print carrier rests and guided by said transport device;

a cleaning and sealing device disposed behind said guide plate and being displaceable towards said inkjet print head and away from said inkjet print head;

an inkjet printing module holder defining an axis of rotation and holding said at least one inkjet print head, said inkjet print head being moveable in rotation about said axis of rotation being parallel to a transport direction of the print carrier;

a microprocessor controlled motor, said inkjet printing module holder being pivoted under motor drive of said motor into a printing position and a spray-cleaning position; and a baffle element disposed and moveable between said cleaning and sealing device and said inkjet printing module holder, said baffle element being movable relative to said inkjet printing module holder and, during spray cleaning, said baffle element being positioned in a flat space or in a plane parallel to said nozzle surface of said at least one inkjet print head.

10. The inkjet printing system according to claim 9, further comprising a baffle plate, said baffle element being a constituent part of a baffle plate;

a common drive for moving said baffle plate and said inkjet printing module holder, said at least one inkjet print head can be moved by said inkjet printing module holder from the printing position into the spray-cleaning position on said baffle plate and into at least one further position and back again in a corresponding way; and stops for setting positions of said inkjet printing module holder.

11. The inkjet printing system according to claims 10, further comprising:

a wheel fixed to said inkjet printing module holder for allowing said inkjet printing module holder to rotate, said baffle plate having a side swinging arm with a guide edge integrally molded on said side swinging arm;

a tension spring; and a frame connected to said baffle plate via said tension spring, said wheel bearing on said guide edge with a force fit and, with said guide edge, forming a guide slot for said baffle plate.

12. The inkjet printing system according to claim 11, wherein said baffle element has a paper layer or film strip which is moved during, before or after the spray cleaning, a movement of the paper layer or the film strip being effected by said common drive which moves said inkjet printing module holder and said baffle plate.

13. The inkjet printing system according to claim 11, wherein said baffle element has a mechanism and is a movable baffle element rotatably mounted on said baffle plate and is caused to rotate onward step by step by said mechanism, said mechanism being driven by said common drive which moves said inkjet printing module holder and said baffle plate.

14. The inkjet printing system according to claim 10, further comprising a bearing pin;

wherein said common drive being said motor and said motor being at least one actuating motor having a shaft;

a microprocessor controller;

a rotary encoder, said baffle plate having a tray-shaped disk, disposed so as to rotate on said bearing pin and rotated into another position by a movement of said inkjet printing module holder, said at least one actuating motor and said rotary encoder connected to said microprocessor controller for the displacement of said inkjet printing module holder; and wherein one of said stops being a first stop for defining the printing position.

15. The inkjet printing system according to claim 14, wherein:

said baffle plate has a paper disk configured such that said paper disk can be replaced easily; and said actuating motor is driven, for displacing said inkjet printing module holder, by said microprocessor controller so that said shaft of said actuating motor moves onward during the spray cleaning, so that said at least one inkjet print head is moved onward relative to said baffle plate in the spray-cleaning position.

16. The inkjet printing system according to claim 14, wherein said tray-shaped disk is rotated into another position by a movement of said inkjet printing module holder only when said baffle plate strikes a further stop.

17. The inkjet printing system according to claim 14, wherein:

said at least one actuating motor is driven by said microprocessor controller such that said baffle plate is moved as a result of displacement of said inkjet printing module holder;

said tray-shaped disk is rotated into another position when said baffle plate strikes a further stop; and said shaft of said actuating motor is moved onward during the spray cleaning, so that said at least one inkjet print head is moved onward relative to said baffle plate in the spray-cleaning position.

18. The inkjet printing system according to claim 10, wherein the spray-cleaning position on said baffle plate is arranged so close to the printing position that a time to move said at least one inkjet print head into the spray-cleaning position and back again into the printing position is shortest as compared with other positions.

19. In an inkjet printing system containing a guide plate having a printing window formed therein, at least one inkjet print head having a surface nozzle and disposed in a stationary manner and can pivot behind the guide plate in the printing window, a transport device disposed next to the guide plate on which a print carrier rests and guided by the transport device, and a cleaning and sealing device disposed behind the guide plate and being displaceable towards the inkjet print head and away from the inkjet print head, a device for spray cleaning the at least one inkjet print head, the device comprising:

an inkjet printing module holder defining an axis of rotation and holding the at least one inkjet print head, the inkjet print head being moveable in rotation about said axis of rotation being parallel to a transport direction of the print carrier;

a microprocessor controlled motor, said inkjet printing module holder being pivoted under motor drive of said motor into a printing position and a spray-cleaning position; and a baffle element disposed and moveable between the cleaning and sealing device and the inkjet printing module holder, said baffle element moving relative to the inkjet printing module holder and, during spray cleaning, said baffle element being positioned in a flat space or in a plane parallel to said nozzle surface of the at least one inkjet print head.

* * * * *